US006174040B1

(12) United States Patent
Hotomi

(10) Patent No.: US 6,174,040 B1
(45) **Date of Patent: *Jan. 16, 2001**

(54) INKJET PRINTING HEAD AND INKJET PRINTING HEAD MANUFACTURING METHOD

(75) Inventor: Hideo Hotomi, Nishinomiya (JP)

(73) Assignee: Minolta Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/013,586

(22) Filed: Jan. 26, 1998

(30) Foreign Application Priority Data

Jan. 31, 1997 (JP) ..... 9-018497

(51) Int. Cl.[7] ..... B41J 2/14
(52) U.S. Cl. ..... 347/20; 216/27
(58) Field of Search ..... 347/40, 44, 20, 347/68, 71; 216/27

(56) References Cited

U.S. PATENT DOCUMENTS

| | | | | |
|---|---|---|---|---|
| 4,369,455 | | 1/1983 | McConica et al. . | |
| 4,503,444 | | 3/1985 | Tacklind . | |
| 4,766,671 | * | 8/1988 | Utsumi et al. | 29/848 |
| 4,968,992 | * | 11/1990 | Komuro | 347/64 |
| 5,208,605 | | 5/1993 | Drake . | |
| 5,412,410 | | 5/1995 | Rezanka | 347/15 |
| 5,444,471 | | 8/1995 | Usui et al. | 347/72 |
| 5,446,485 | | 8/1995 | Usui et al. | 347/72 |
| 5,458,254 | * | 10/1995 | Miyagawa et al. | 216/27 |
| 5,637,126 | * | 6/1997 | Ema et al. | 65/31 |
| 5,682,187 | * | 10/1997 | Watanabe et al. | 347/45 |
| 5,808,644 | * | 9/1998 | Imamura et al. | 347/93 |

FOREIGN PATENT DOCUMENTS

| | | | |
|---|---|---|---|
| 0437062 | | 7/1991 | (EP) . |
| 2282992 | | 4/1995 | (GB) . |
| 8-001951 | * | 1/1996 | (JP) . |

* cited by examiner

*Primary Examiner*—Robert Beatty
(74) *Attorney, Agent, or Firm*—Sidley & Austin

(57) ABSTRACT

An inkjet printing head is provided with an ink chamber forming member constructed of a ceiling plate and a glass thin plate which are made from identical photosensitive glass material. A plurality of groove-shaped recess are formed in parallel and at a regular pitch on one surface of the ceiling plate. The glass thin plate is integrally connected by heat treatment to a recess portion formation surface of the ceiling plate. With this arrangement, the inside of each of the recess covered with the glass thin plate serves as an ink chamber. In a manufacturing method of the ink chamber forming member, a photosensitive glass is coated to predetermined thickness on a support body. Subsequently, the photosensitive glass is subjected to pattern exposure via a mask plate. Through this process, the ultraviolet ray is applied to a portion which belongs to the photosensitive glass and corresponds to an area which is not masked, so that glass crystallization progresses only in this portion and a solubility to acid is developed. Then, the exposed photosensitive glass and the support body are immersed in an aqueous solution for chemical etching. Through this process, the exposed portion is melted to a specified depth, so that the plurality of recesses which serve as the ink chambers are formed. Subsequently, the photosensitive glass is crystallized through a heat treatment process for baking it, thereby obtaining the ceiling plate. Next, the ceiling plate is superposed on the glass thin plate, and the whole body is baked. Through this heat treatment, the ceiling plate and the glass thin plate are fused to be integrated into a body.

5 Claims, 4 Drawing Sheets

INKJET PRINTING HEAD AND INKJET PRINTING HEAD MANUFACTURING METHOD

This application is based on application No. 9-18497 filed in Japan, the contents of which is hereby incorporated by reference.

BACKGROUND OF THE INVENTION

1. Field of the Invention

The present invention relates to an inkjet printing head for recording an image by discharging an ink drop from a nozzle according to an image signal and making this adhere to a recording medium such as a recording paper, and also relates to an inkjet printing head manufacturing method.

2. Description of the Related Art

There has been conventionally known an inkjet printing head for discharging an ink drop from a nozzle by pressurizing ink stored in an ink chamber by means of a piezoelectric actuator.

In this type of inkjet printing head, there has been the general practice of forming a plurality of recess portions in an ink chamber forming member, covering the recess portions with a diaphragm and a nozzle plate formed of a thin plate of a metal or the like to this by fixation with an adhesive and making the inside of each of the aforementioned recess portions covered with this diaphragm and so forth serve as an ink chamber. As a method for forming such an ink chamber forming member, there is a forming method achieved by growing a metal layer into a specified pattern utilizing a resist by electroforming.

However, when forming an ink chamber forming member by electroforming, a thick film is formed by controlling electrification of a metal plating liquid, and this has led to the problem that much time is required for obtaining a metal layer of a desired thickness and therefore the production cost increases. Furthermore, since the ink chamber is formed by fixing by the adhesive the diaphragm and so forth to the ink chamber forming member manufactured through the above processes, an assembling process with coating of the adhesive is required, and this has also caused a cost increase.

OBJECTS AND SUMMARY

It is an object of the present invention to provide an improved inkjet printing head and inkjet printing head manufacturing method.

It is another object of the present invention to provide an easily manufacturable inkjet printing head and inkjet printing head manufacturing method.

It is a further object of the present invention to provide a low-manufacturing-cost inkjet printing head and inkjet printing head manufacturing method.

In order to achieve the above objects and other objects, an inkjet printing head of an embodiment comprises an ink chamber forming member constructed of a ceiling plate made of a photosensitive glass provided with a plurality of recess portions by pattern exposure and etching and a glass thin plate which is integrally connected to a recess portion formation surface of this ceiling plate by heat treatment, and the inside of each of the aforementioned recess portions covered with the glass thin plate serves as an ink chamber.

In this inkjet printing head, it is preferable to form the aforementioned glass thin plate with a photosensitive glass raw material identical to that of the aforementioned ceiling plate. Furthermore, a nozzle communicating with the ink chamber may be formed on the ceiling plate by pattern exposure and etching.

Furthermore, the inkjet printing head manufacturing method of an embodiment comprises an exposure process for subjecting a photosensitive glass to pattern exposure, an etching process for forming a plurality of recess portions by etching the exposed photosensitive glass, a heat treatment process for crystallizing the etched photosensitive glass and a connecting process for integrally connecting by a heat treatment the glass thin plate to the recess portion formation surface of the crystallized photosensitive glass.

According to the aforementioned inkjet printing head and its manufacturing method, the ink chamber forming member can be manufactured in a shorter time than in a case where a member having a recess portion for an ink chamber is formed by electro forming, therefore allowing the production cost to be reduced. Since this is not the one in which the ink chamber is formed by fixing a plurality of members with an adhesive, the process for coating the adhesive is eliminated to allow the assembling process to be simplified. Furthermore, since the ink chamber wall surface made of glass has a good wettability for a watercolor ink, the flow of ink due to a capillary phenomenon becomes smooth and the generation of air bubbles can be prevented.

In a case where the glass thin plate to be connected to the ceiling plate is formed of a photosensitive glass of the same raw material, an adhesive strength increases more than in a case where glass thin plates of different materials are connected together, thereby allowing a long operating life to be achieved.

Furthermore, in a case where a nozzle communicating with the ink chamber is formed at the ceiling plate, there is no need for separately providing a nozzle plate, therefore allowing the production cost to be further reduced.

BRIEF DESCRIPTION OF THE DRAWINGS

These and other objects and features of the present invention will become apparent from the following description of preferred embodiments thereof taken in conjunction with the accompanying drawings, in which.

In the following description, like parts are designated by like reference numbers throughout the several drawings.

DETAILED DESCRIPTION OF THE PREFERRED EMBODIMENTS

Embodiments of the present invention will be described below with reference to the accompanying drawings.

Figure 1:
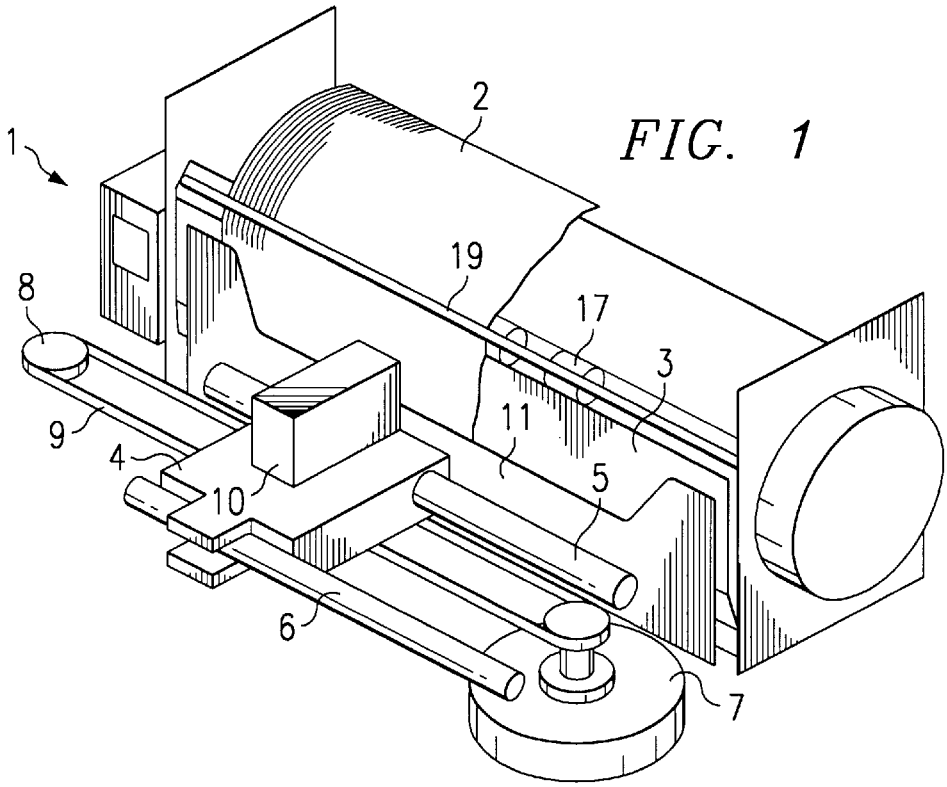
FIG. 1 is a perspective view showing an inkjet printer.

FIG. 1 is a perspective view showing the schematic construction of an inkjet printer 1.

The inkjet printer 1 includes a recording sheet 2 which is a recording medium such as a paper, resin film or the like, a printing head 10 of an inkjet system, a carriage 4 for holding the printing head 10, slide shafts 5 and 6 along which the carriage 4 is reciprocated in parallel with the recording surface of the recording sheet 2, a drive motor 7 for reciprocating the carriage 4 along the slide shafts 5 and 6, a timing belt 9 for transforming the rotation of the drive motor 7 into a reciprocating motion of the carriage and an idling pulley 8.

The inkjet printer 1 includes a platen 3 which concurrently serves as a guide plate for guiding the recording sheet 2 along a conveyance path, a paper pressing plate 11 for preventing the rising of the recording sheet 2 between it and the platen 3 by pressing the sheet, a discharging roller 17 for discharging the recording sheet 2 and a spur roller 19.

The recording sheet 2 is fed into a recording section in which the printing head 10 and the platen 3 face each other by a paper feeder such as a manual or cut sheet feeder or the like. In this stage, the amount of rotation of a paper feeding roller (not shown) is controlled, so that the conveyance to the recording section is controlled.

A piezoelectric element is used for the printing head 10. A voltage is applied to the piezoelectric element, thereby causing a distortion. This distortion changes the volume of the channel filled with ink. Due to the change in volume, the ink is discharged from the nozzle provided at the channel, so that recording on the recording sheet 2 is performed.

The printing head 10 performs image recording by means of inks of four colors of Y (yellow), M (magenta), C (cyan) and K (black).

The carriage 4 performs main scanning in the direction of row of the recording sheet 2 (in the transverse direction of the recording sheet 2) with the drive motor 7, the idling pulley 8 and the timing belt 9, and the printing head 10 mounted on the carriage 4 and records an image of one line. Every time the recording of one line is completed, the recording sheet 2 is fed in the vertical direction to be subjected to sub-scanning, and the next line is recorded.

Figure 2:
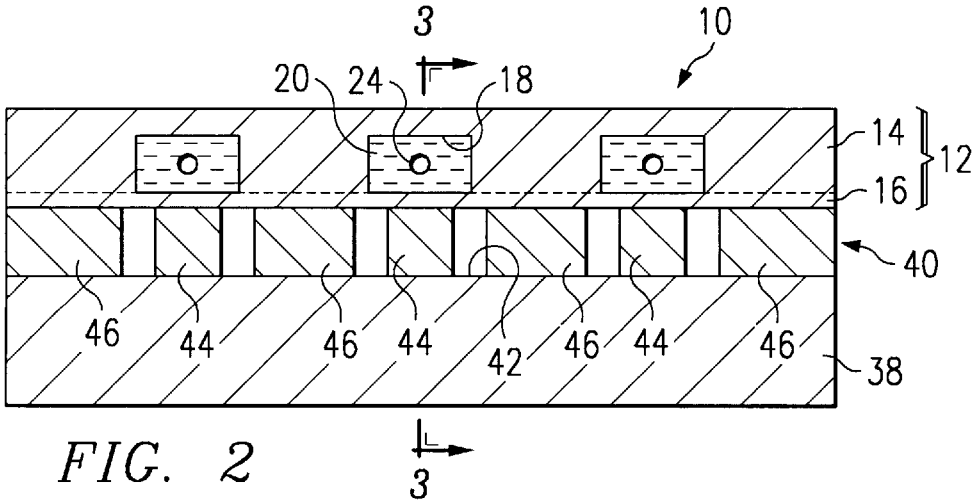
FIG. 2 is a sectional view of an inkjet printing head.
Figure 3:
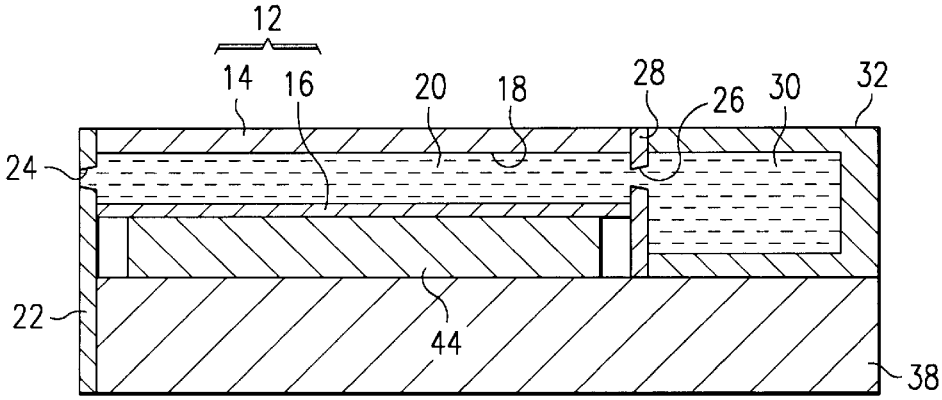
FIG. 3 is a sectional view taken along the line II—II of the inkjet printing head shown in FIG. 2.

FIGS. 2 and 3 are views showing the inkjet printing head 10.

This head 10 is provided with an ink chamber forming member 12 constructed of a ceiling plate 14 and a glass thin plate 16.

A plurality of groove-shaped recess portions 18 are formed in parallel and at a regular pitch on one surface of the ceiling plate 14 by pattern exposure and etching as described later. The glass thin plate 16 is integrally connected by heat treatment to a recess portion formation surface of the ceiling plate 14. With this arrangement, the inside of each of the aforementioned recess portions 18 covered with the glass thin plate 16 serves as an ink chamber 20. The ink chamber 20 has a rectangular-shaped section and is elongated as shown in FIG. 3. It is to be noted that the shape of the recess portion 18 is not limited to the elongated groove shape, and it may be a recess portion having a square shape, a circular shape or the like viewed from the recess portion formation surface side.

As shown in FIG. 3, a nozzle plate 22 is adhered to one end surface of the ink chamber forming member 12. At the nozzle plate 22 is formed a tapered nozzle 24 communicating with one end of each ink chamber 20. To the other end surface of the ink chamber forming member 12 is adhered an orifice plate 28 having an ink inlet 26 corresponding to each ink chamber 20. To the orifice plate 28 is adhered an ink supply chamber forming member 32 internally having an ink supply chamber 30.

The ink supply chamber 30 is communicating with the ink chamber 20 via the ink inlet 26 and connected to an ink tank (not shown).

The aforementioned nozzle plate 22, orifice plate 28 and ink supply chamber forming member 32 are also supported by a base plate 38 made of ceramic, metal, glass, plastic or the like.

Between the aforementioned ink chamber forming member 12 and the base plate 38 is fixed a diaphragm 40. The diaphragm 40 is made of a known piezoelectric material (e.g., PZT) and has its upper surface and lower surface provided with conductive metal layers (not shown) which function as a common electrode and an individual electrode, respectively, and are formed by plating, sputtering or a similar method. The diaphragm 40 is segmented by forming a plurality of separate grooves 42 through a dicing process, so that it is separated into a piezoelectric actuator 44 which faces the ink chamber 20 via the glass thin plate 16 and a support wall 46 other than it. Each piezoelectric actuator 44 is polarized by applying at a high temperature a high voltage across the common electrode and the individual electrode located on the upper and lower sides.

Figure 4:
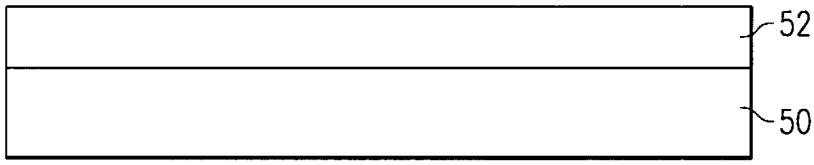
FIG. 4 is a view for explaining a manufacturing process of an ink chamber forming member.

A manufacturing method of the aforementioned ink chamber forming member 12 will be described next with specific material names and numeric values exemplified. As shown in FIG. 4, a photosensitive glass 52 is coated to a thickness of about 350 $\mu$m on a support body 50. PEG-3C produced by HOYA CORP. is used for the photosensitive glass 52, and mirror-finished #7059 glass, which is produced by Corning Inc., slightly coated with a wax for releasing use is used for the support body.

Figure 5:
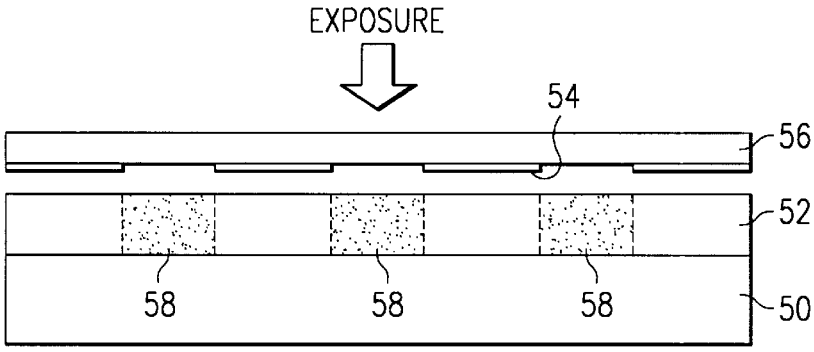
FIG. 5 is a view for explaining a manufacturing process of the ink chamber forming member.

Subsequently, as shown in FIG. 5, the aforementioned photosensitive glass 52 is subjected to pattern exposure for 15 seconds with a G-line ultraviolet ray (or a broad ultraviolet ray is acceptable) at 250 mJ/cm$^2$ via a quartz glass plate 56 masked with a Cr layer 54. Through this process, the ultraviolet ray is applied to a portion 58 which belongs to the photosensitive glass 52 and corresponds to an area which is not masked by the Cr layer 54, so that glass crystallization progresses only in this portion 58 and a solubility to acid is developed.

Figure 6:
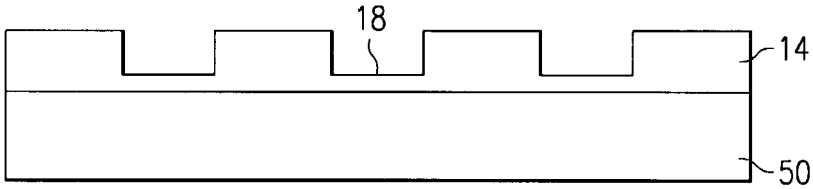
FIG. 6 is a view for explaining a manufacturing process of the ink chamber forming member.

Then, the aforementioned exposed photosensitive glass 52 and the support body 50 are immersed in an 2N $H_2SO_4$ aqueous solution for 30 minutes for chemical etching. Through this process, the exposed portion 58 is melted to a specified depth as shown in FIG. 6, so that the plurality of recess portions 18 which serve as the ink chambers 20 are formed. Subsequently, the photosensitive glass is crystallized through a heat treatment process for baking it at 90° C. for 30 minutes, thereby obtaining the aforementioned ceiling plate 14.

Figure 7:
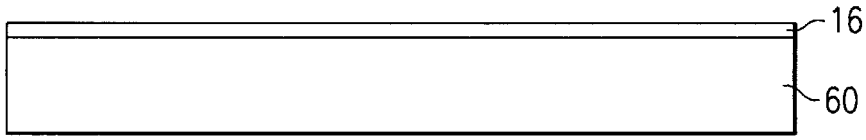
FIG. 7 is a view for explaining a manufacturing process of the ink chamber forming member.

Next, as shown in FIG. 7, a glass material identical to that for use in manufacturing the photosensitive glass 52 is coated to a thickness of about 30 μm on another support body 60, and this is baked at 90° C. for 30 minutes, thereby obtaining the aforementioned glass thin plate 16.

Figure 8:
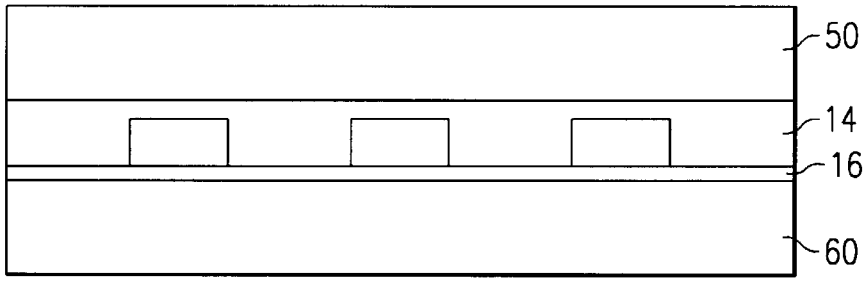
FIG. 8 is a view for explaining a manufacturing process of the ink chamber forming member.
Figure 9:
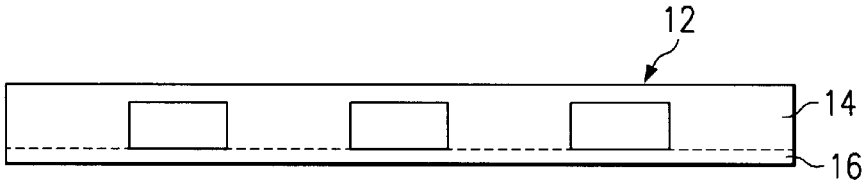
FIG. 9 is a view for explaining a manufacturing process of the ink chamber forming member.

Subsequently, the ceiling plate 14 and the support body 50 shown in FIG. 6 are inverted as shown in FIG. 8 and superposed on the glass thin plate 16 shown in FIG. 7, and the whole body is baked at 150° C. for one hour with a load of 500 g/cm$^2$ applied from above. Through this heat treatment, the ceiling plate 14 and the glass thin plate 16 are fused to be integrated into a body. Subsequently, by removing the support bodies 50 and 60, the ink chamber forming member 12 is completed as shown in FIG. 9.

According to the aforementioned manufacturing method of the inkjet printing head 10 and the ink chamber forming member 12, the ink chamber forming member 12 can be manufactured in a shorter time than in the case where a member having a recess portion for ink chamber use is manufactured by electroforming, therefore allowing the production cost to be reduced. Furthermore, the aforementioned ink chamber forming member 12 is obtained by integrally connecting the ceiling plate 14 with the glass thin plate 16 through a heat treatment, not by fixing them with an adhesive, and therefore, the process for coating an adhesive is eliminated to allow the assembling process to be simplified.

Furthermore, in regard to the ink chamber forming member 12, the ceiling plate 14 and the glass thin plate 16 to be connected to this are formed of an identical glass material. Therefore, the adhesive strength is increased further than in the case where glass thin plates of different materials are connected to each other, therefore allowing a long operating life to be achieved. It is also acceptable to connect glass thin plates of different materials with each other.

In the aforementioned inkjet printing head 10, the ink supplied from the ink tank to the ink supply chamber 30 is stored in the ink chamber 20 via the ink inlet 26. When a drive voltage is applied across the common electrode and the individual electrode located respectively on the upper and lower surfaces in accordance with an image signal from a driver circuit (not shown) in this state, the piezoelectric actuator 44 instantaneously extends to be deformed in the direction of thickness to thereby push the glass thin plate 16 toward the ink chamber 20 side. The ink in the ink chamber 20 pressurized by this is discharged as an ink drop from the nozzle 24 and adhered to a recording medium (not shown), thereby recording an image. When the voltage application is canceled, the piezoelectric actuator 44 is restored into its original state, and the ink is supplied from the ink supply chamber 30 into the ink chamber 20 by the capillary phenomenon. An ink flow thus occurs inside the ink chamber 20 in discharging and supplying the ink. However, since the glass-made wall surfaces on the four sides of the ink chamber 20 have a good wettability for the watercolor ink, the aforementioned ink flow becomes smooth, and the entry and generation of air bubbles can be prevented.

Next, an inkjet printing head 70 of another embodiment will be described with reference to FIGS. 10 through 14. Since the construction and the ink discharging operation is the same as the aforementioned inkjet printing head 10 except for the nozzle position, no description is provided therefor.

Figure 10:
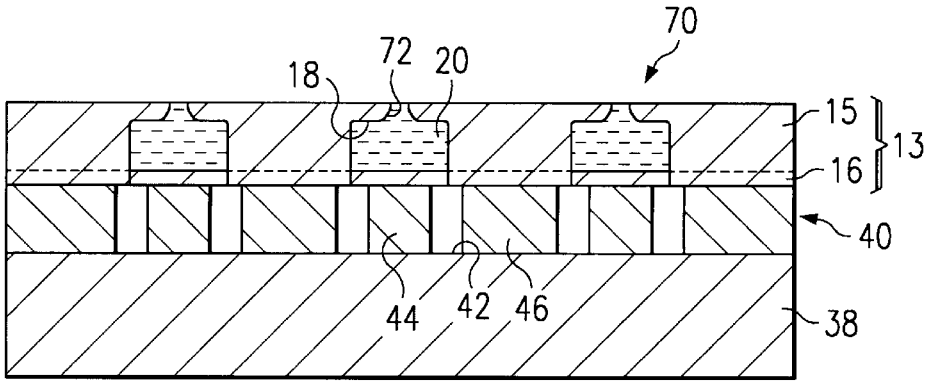
FIG. 10 is a sectional view of an inkjet printing head of another embodiment.

Although the nozzle 24 is provided by adhering the nozzle plate 22 to the end surface of the ink chamber 20 in the aforementioned inkjet printing head 10, a nozzle 72 communicating with each ink chamber 20 may be formed at an ink chamber forming member 13 as in the inkjet printing head 70 shown in FIG. 10. In this case, a blocking plate provided with no hole is adhered to the end surface of the ink chamber forming member 12 in place of the nozzle plate 22.

Figure 11:
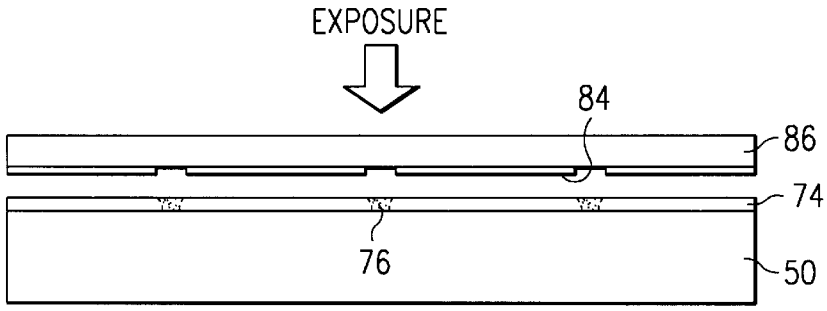
FIG. 11 is a view for explaining a manufacturing process of an ink chamber forming member.

The ink chamber forming member 13 having the aforementioned nozzle 72 is manufactured as follows. First, as shown in FIG. 11, a fluorine containing coating material (not shown) is coated on the support body 50 on which a wax for releasing use is applied, and thereafter a photosensitive glass 74 is coated on it to a thickness of about 80 μm. Subsequently, it is subjected to pattern exposure of an ultraviolet ray via a quartz glass plate 86 masked with a Cr layer 84, thereby crystallizing a portion 76 which belongs to the photosensitive glass 74 and becomes the nozzle 72. In this stage, by weakening the exposure conditions to 180 mJ/cm$^2$ and 8 seconds, the aforementioned portion 76 can be made to have a tapered shape.

Figure 12:
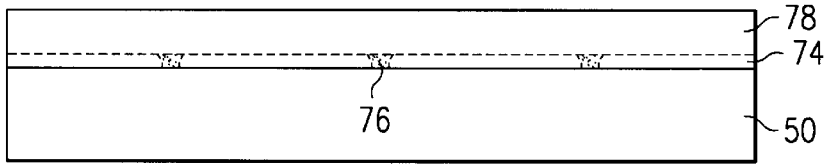
FIG. 12 is a view for explaining a manufacturing process of the ink chamber forming member.
Figure 13:
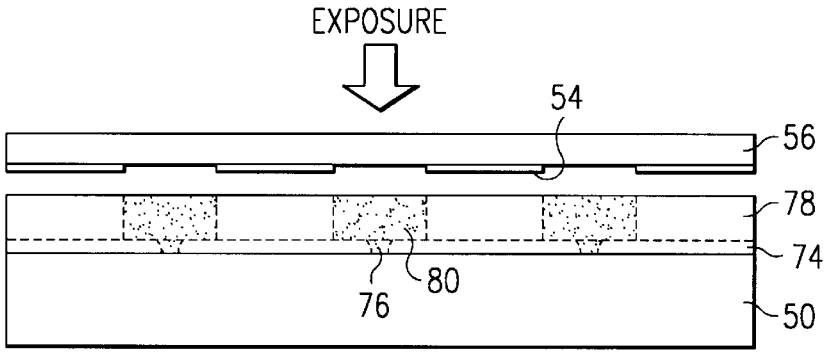
FIG. 13 is a view for explaining a manufacturing process of the ink chamber forming member.
Figure 14:
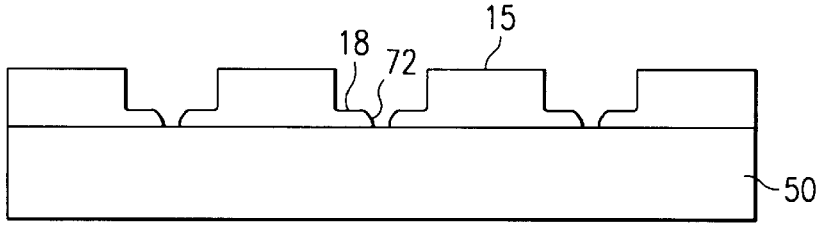
FIG. 14 is a view for explaining a manufacturing process of the ink chamber forming member.

Next, as shown in FIG. 12, a photosensitive glass 78 is coated to a thickness of about 300 μm on the aforementioned photosensitive glass 74. Subsequently, as shown in FIG. 13, this photosensitive glass 78 is subjected to pattern exposure with an ultraviolet ray via the quartz glass plate 56 masked with the Cr layer 54, thereby crystallizing a portion 80 which is to be a groove-shaped recess portion 18 for ink chamber 20 use. Then, by immersing these photosensitive glass 74 and photosensitive glass 78 in an $H_2SO_4$ aqueous solution to chemically etch the aforementioned portions 76 and 80 and then integrally baking them, a ceiling plate 15 having the nozzle 72 can be obtained as shown in FIG. 14. This process of connecting the glass thin plate 16 to the ceiling plate 15 is the same as that in the case of the aforementioned ink chamber forming member 12 (see FIGS. 7 through 9).

When the nozzle 72 is thus formed at the ink chamber forming member 13, there is no need for providing any separate nozzle plate, therefore allowing the production cost to be further reduced.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An inkjet printing head comprising:

a ceiling plate made of a photosensitive glass having a surface on which a nozzle hole and a recess are formed by pattern exposure and etching, said nozzle hole and said recess being in fluid communication with each other; and a glass thin plate which is integrally fixed to said surface of the ceiling plate by heat treatment so that the recess is covered with said glass thin plate, wherein said covered recess serves as an ink chamber, said glass thin plate being made of a photosensitive glass raw material identical to that of said ceiling plate.

2. An inkjet printing head manufacturing method comprising the steps of:

(a) exposing a photosensitive glass to light through a pattern which corresponds to a nozzle;

(b) coating the photosensitive glass, which is exposed to the light by said exposing step (a), with a photosensitive glass being made of a photosensitive glass raw material identical to that of said photosensitive glass of said exposing step (a);

(c) exposing the coated photosensitive glass to light through a pattern which corresponds to a recess;

(d) etching a nozzle and a recess which correspond to said patterns on said photosensitive glass which is exposed by said steps (a) and (c);

(e) crystallizing the photosensitive glass etched by said step (d) through a heat treatment process; and (f) superposing said crystallized photosensitive glass and a glass thin plate and baking them so that said crystallized photosensitive glass and the glass thin plate are fused to be integrated into one unit, said glass thin plate being made of a photosensitive glass raw material identical to that of said photosensitive glass.

3. An inkjet printing head manufacturing method as claimed in claim 2, wherein said step (d) includes a step of immersing the exposed photosensitive glass in an aqueous solution for chemical etching.

4. An inkjet printing head manufacturing method comprising the steps of:

(a) coating a support body with a photosensitive glass material to a predetermined thickness;

(b) exposing the photosensitive glass material to light through a mask pattern corresponding to an ink nozzle, whereby the photosensitive glass material belonging to a non-masked area is crystallized;

(c) coating said exposed photosensitive glass material with a photosensitive glass material, which is identical to said exposed photosensitive glass material, to a predetermined thickness;

(d) exposing the coated photosensitive glass material to light through a mask pattern corresponding to a recess, whereby the photosensitive glass material belonging to a non-masked area is crystallized;

(e) immersing said exposed photosensitive glass material and the support body in an aqueous solution for chemical etching so that the photosensitive glass material of the non-masked area is melted to a specified depth to form a nozzle and a recess, said nozzle and said recess being in fluid communication with each other;

(f) baking said photosensitive glass material having the nozzle, the recess and the support body to crystallize said photosensitive glass material;

(g) covering the recess on the photosensitive glass material with a glass thin plate, said glass thin plate being made of a photosensitive glass raw material identical to said photosensitive glass material;

(h) baking the photosensitive glass material and the glass thin plate so that the photosensitive glass material and the glass thin plate are fused to be integrated into one unit; and (i) removing the support body from the photosensitive glass material.

5. An inkjet printing head comprising:

a nozzle portion made of a photosensitive glass material having a nozzle formed by pattern exposure and etching;

a ceiling plate made of a photosensitive glass material, said photosensitive glass material being identical to said photosensitive glass material of said nozzle portion, said ceiling plate having a surface on which a recess is formed by pattern exposure and etching, said ceiling plate being integrally fixed to said nozzle portion so that said recess and said nozzle are in fluid communication; and a glass thin plate being integrally fixed to said surface of said ceiling plate by heat treatment so that said recess is covered with said glass thin plate, said glass thin plate being made of a photosensitive glass material identical to said photosensitive glass material of said nozzle portion, wherein said thus covered recess serves as an ink chamber.

* * * * *